US008286735B1

(12) United States Patent
Cooley et al.

(10) Patent No.: US 8,286,735 B1
(45) Date of Patent: Oct. 16, 2012

(54) DRILL BIT HAVING ROTATIONAL CUTTING ELEMENTS AND METHOD OF DRILLING

(75) Inventors: Craig H. Cooley, Saratoga Springs, UT (US); Jeffery B. Lund, Cottonwood Heights, UT (US); Jair J. Gonzalez, Provo, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

(21) Appl. No.: 13/330,471

(22) Filed: Dec. 19, 2011

Related U.S. Application Data

(63) Continuation of application No. 12/405,585, filed on Mar. 17, 2009, now Pat. No. 8,079,431.

(51) Int. Cl.
*E21B 10/62* (2006.01)
*E21B 10/633* (2006.01)

(52) U.S. Cl. ..... 175/382; 175/412; 175/413; 175/431; 175/432

(58) Field of Classification Search ..... 175/381, 175/382, 383, 412, 413, 431, 432
See application file for complete search history.

(56) References Cited

U.S. PATENT DOCUMENTS

| | | | |
|---|---|---|---|
| 1,686,403 | A | 10/1928 | Boynton |
| 1,723,381 | A | 8/1929 | Seifert |
| 1,790,613 | A | 1/1931 | Gildersleeve et al. |
| 2,289,707 | A | 7/1942 | Hellman |
| 2,506,341 | A | 5/1950 | Bullock |
| 2,631,360 | A | 3/1953 | Sanford et al. |
| 2,710,180 | A | 6/1955 | Graham |
| 2,879,049 | A | 3/1959 | Poundstone |
| 2,917,819 | A | 12/1959 | Britton et al. |
| 3,136,615 | A | 6/1964 | Bovenkerk et al. |
| 3,141,746 | A | 7/1964 | De Lai |
| 3,271,080 | A | 9/1966 | Gowanlock |
| 3,528,516 | A | 9/1970 | Brown |
| 3,565,192 | A | 2/1971 | McLarty |
| 3,593,812 | A | 7/1971 | Peterson |
| 3,720,273 | A | 3/1973 | McKenry et al. |

(Continued)

FOREIGN PATENT DOCUMENTS

| | | |
|---|---|---|
| WO | 86/06990 | 12/1986 |

(Continued)

OTHER PUBLICATIONS

Vibration Reduced Rotation by Patrick Andreas Petri, Massachusetts Institute of Technology, May 2001.

*Primary Examiner* — Giovanna Wright
(74) *Attorney, Agent, or Firm* — Holland & Hart LLP

(57) ABSTRACT

A rotary drill bit is disclosed. The rotary drill bit may include a bit body, a cutting pocket defined in the bit body, and a cutting element rotatably coupled to the bit body. The cutting element may be positioned at least partially within the cutting pocket. The rotary drill bit may also include a rotation-inducing member adjacent to the cutting element for inducing rotation of the cutting element relative to the cutting pocket. The rotation-inducing member may include a resilient member or a vibrational member. The rotary drill bit may also include protrusions extending from an interior of the cutting pocket adjacent to an outer diameter of the cutting element. A method of drilling a formation is also disclosed.

27 Claims, 10 Drawing Sheets

U.S. PATENT DOCUMENTS 3,749,190 A 7/1973 Shipman
3,763,492 A 10/1973 Easton
3,847,236 A 11/1974 Coalson
4,014,395 A 3/1977 Pearson
4,047,583 A 9/1977 Dyer
4,057,884 A 11/1977 Suzuki
4,073,354 A 2/1978 Rowley et al.
4,199,035 A 4/1980 Thompson
4,200,159 A 4/1980 Peschel et al.
4,201,421 A 5/1980 Den Besten et al.
4,222,446 A 9/1980 Vasek
4,337,980 A 7/1982 Krekeler
4,350,215 A 9/1982 Radtke
4,386,669 A 6/1983 Evans
4,396,077 A 8/1983 Radtke
4,453,605 A 6/1984 Short
4,466,498 A 8/1984 Bardwell
4,511,006 A 4/1985 Grainger
4,538,690 A 9/1985 Short
4,553,615 A 11/1985 Grainger
4,654,947 A 4/1987 Davis
4,690,228 A 9/1987 Voelz et al.
4,694,918 A 9/1987 Hall
4,720,216 A 1/1988 Smith
4,751,972 A 6/1988 Jones et al.
4,782,903 A 11/1988 Strange
4,802,539 A 2/1989 Hall et al.
4,877,096 A 10/1989 Tibbitts
5,007,493 A 4/1991 Coolidge et al.
5,007,685 A 4/1991 Beach et al.
5,056,382 A 10/1991 Clench
5,279,375 A 1/1994 Tibbitts
5,332,051 A 7/1994 Knowlton
5,351,772 A 10/1994 Smith
5,469,927 A 11/1995 Griffin
5,558,170 A 9/1996 Thigpen et al.
5,678,645 A 10/1997 Tibbitts
5,810,103 A 9/1998 Torbet
5,906,245 A 5/1999 Tibbitts et al.
5,975,811 A 11/1999 Briese
6,073,524 A 6/2000 Weiss et al.
6,283,234 B1 9/2001 Torbet
6,302,224 B1 10/2001 Sherwood, Jr.
6,408,959 B2 6/2002 Bertagnolli et al.
6,733,365 B1 5/2004 Shaw
7,192,226 B2 3/2007 Unsworth
7,533,739 B2 5/2009 Cooley et al.
2002/0053472 A1 5/2002 Kleine
2004/0026132 A1 2/2004 Hall et al.
2005/0072601 A1 4/2005 Griffo et al.
2005/0103533 A1 5/2005 Sherwood et al.
2008/0017419 A1* 1/2008 Cooley et al. ..... 175/286
2008/0085407 A1 4/2008 Cooley et al.
2008/0236900 A1 10/2008 Cooley et al.

FOREIGN PATENT DOCUMENTS

WO 2005021191 3/2005
WO 2007044791 4/2007

* cited by examiner

DRILL BIT HAVING ROTATIONAL CUTTING ELEMENTS AND METHOD OF DRILLING

CROSS-REFERENCE TO RELATED APPLICATIONS

This application is a continuation of, and claims priority to, U.S. patent application Ser. No. 12/405,585, filed Mar. 17, 2009, which will issue as U.S. Pat. No. 8,079,431 on Dec. 20, 2011, the disclosure of which is incorporated by reference herein in its entirety.

BACKGROUND

Rotary drill bits employing polycrystalline diamond compact ("PDC") cutters have previously been employed for drilling subterranean formations. Conventional PDC cutters may comprise a diamond table formed under ultra high temperature, ultra high pressure conditions onto a substrate, typically of cemented tungsten carbide. Conventional drill bit bodies may comprise a so-called tungsten carbide matrix including tungsten carbide particles distributed within a binder material or may comprise steel. Tungsten carbide matrix drill bit bodies may be fabricated by preparing a mold that embodies the inverse of the desired generally radially extending blades, cutting element sockets or pockets, junk slots, internal watercourses and passages for delivery of drilling fluid to the bit face, ridges, lands, and other external topographic features of the drill bit. Particulate tungsten carbide may then be placed into the mold and a binder material, such as a metal including copper and tin, may be melted into the tungsten carbide particulate and solidified to form the drill bit body. Steel drill bit bodies may be fabricated by machining a piece of steel to form generally radially extending blades, cutting element sockets or pockets, junk slots, internal watercourses and passages for delivery of drilling fluid to the bit face, ridges, lands, and other external topographic features of the drill bit. In both matrix-type and steel bodied drill bits, a threaded pin connection may be formed for securing the drill bit body to the drive shaft of a downhole motor or directly to drill collars at the distal end of a drill string rotated at the surface by a rotary table, top drive, drilling motor (pdm) or turbine.

Conventional cutting element retention systems or structures that have been employed generally comprise the following two styles: (1) tungsten carbide studs comprising a cylindrical tungsten carbide cylinder having a face oriented at an angle (back rake angle) with respect to the longitudinal axis of the cylinder, the face carrying a superabrasive cutting structure thereon, wherein the cylinder is press-fit into a recess that is generally oriented perpendicularly to the blades extending from the bit body on the bit face; and (2) brazed attachment of a generally cylindrical cutting element into a recess (e.g., a cutter pocket) formed on the bit face, typically on a blade extending from the bit face. Accordingly, the first cutting element retention style is designed for a stud type cutting element, while the second cutting element retention style is designed for generally cylindrical cutting elements, such as PDC cutters. In either system, the orientation of the cutting elements is held stationary relative to the bit body as the drill bit is used. Of the two different types of cutting element retention configurations utilized in the manufacture of rotary drill bits, cylindrical cutting elements are generally more common. Stud-type cutting elements, on the other hand, are relatively uncommon and may require a brazing or infiltration cycle to affix the PDC or TSPs to the stud.

SUMMARY

According to at least one embodiment, a rotary drill bit may comprise a bit body, a cutting pocket defined in the bit body, and a cutting element rotatably coupled to the bit body, the cutting element being positioned at least partially within the cutting pocket. The rotary drill may also comprise a rotation-inducing member adjacent to the cutting element for inducing rotation of the cutting element relative to the cutting pocket. A gap may be defined between the cutting element and the cutting pocket. Optionally, the cutting element may be coupled to the bit body such that the cutting element may be moved within the cutting pocket. The cutting element may be capable of contacting one or more surfaces of the cutting pocket.

The rotation-inducing member may also be disposed at least partially within the cutting pocket. The rotation-inducing member may also comprise at least a portion of a cutting pocket surface. In one embodiment, the rotation-inducing member may be disposed between the cutting element and the cutting pocket defined in the bit body. The rotation-inducing member may be configured to induce rolling contact between the cutting element and the cutting pocket. Further, the rotation-inducing member may be configured such that cutting forces acting on the drill bit actuate the rotation-inducing member to induce rotation of the cutting element relative to the cutting pocket. The rotation-inducing member may optionally be configured to induce a net rotation of the cutting element in a single direction relative to the cutting pocket. The rotation-inducing member may be configured to induce rotation of the cutting element relative to the cutting pocket as the drill bit is rotated relative to a formation. The rotation-inducing member may also be configured to induce vibrational movement of the cutting element relative to the cutting pocket.

According to various embodiments the rotation-inducing member may comprise a resilient support member. The resilient support member may comprise a spring element. The resilient support member may comprise at least one of a wave spring washer, a curved spring washer, or a Belleville spring washer. The resilient support member may bias the cutting element within the cutting pocket. According to additional embodiments, the resilient support member may be configured to vibrate in response to cutting forces and therefore may be referenced as a vibrational member. The resilient support member may also be configured to compress in response to cutting forces. Optionally, the resilient support member may be configured to alternately compress and decompress in response to variations in cutting forces.

According to at least one embodiment, the rotation-inducing member may comprise a vibrational member. The vibrational member may be configured to vibrate such that friction between the cutting element and the cutting pocket is reduced. The vibrational member may be configured such that external forces acting on the drill bit induce vibrations in the vibrational member. External forces acting on the drill bit may include cutting forces acting on the drill bit. The vibrational member may be configured to vibrate sufficiently to induce rotation of the cutting element relative to the cutting pocket. Optionally, the vibrational member may comprise at least two vibrational prongs adjacent to the cutting element. The vibrational member may optionally resiliently support at least a portion of the cutting element.

According to various embodiments, the cutting element may comprise a superabrasive material bonded to a substrate, the substrate extending from an interfacial surface to a back surface of the substrate. The rotation-inducing member may be adjacent to at least one of the substrate and the superabrasive material bonded to the substrate. Optionally, the rotation-inducing member may comprise a resilient support member disposed between a back surface of the cutting element and the cutting pocket.

According to certain embodiments, the rotary drill bit may also comprise a structural element coupled to a back surface of the cutting element. The rotary drill bit may further comprise a through hole defined in the bit body, the through hole defined by the cutting pocket, wherein the structural element is rotatably disposed in the through hole. The structural element may comprise an anchor element positioned adjacent to an anchor surface, the anchor element having an outer diameter greater than a diameter of the through hole.

According to at least one embodiment, the cutting element may have a central axis. The cutting element may be coupled to the bit body such that the cutting element and the central axis may be moved within the cutting pocket. The rotation-inducing member may radially surround at least a portion of the cutting element relative to the central axis. The rotation-inducing member may also comprise a resilient member positioned adjacent to an outer diameter of the cutting element. The resilient member may be configured to compress in a direction that is generally transverse to the rotational axis of the cutting element.

According to additional embodiments, the rotary drill bit may comprise one or more protrusions extending from an interior of the cutting pocket adjacent to an outer diameter of the cutting element. The cutting element and the one or more protrusions may be configured such that the cutting element engages and rolls over the one or more protrusions when the cutting element is forced toward the resilient member. The cutting element may be configured to rotate relative to the cutting pocket as it engages and rolls over the one or more protrusions. Optionally, the cutting element and the protrusions may be configured such that the cutting element slides over the one or more protrusion when the cutting element is forced away from the resilient member.

According to at least one embodiment, a method of drilling a formation may comprise providing a drill bit, the drill bit comprising a bit body, a cutting pocket defined in the bit body, a cutting element rotatably coupled to the bit body, the cutting element being positioned at least partially within the cutting pocket, and a rotation-inducing member adjacent to the cutting element. The method may comprise contacting the drill bit to a formation. The method may comprise moving the drill bit relative to the formation. The rotation-inducing member may induce rotation of the cutting element relative to the cutting pocket as the drill bit is moved relative to the formation.

Moving the drill bit relative to the formation may cause the rotation-inducing member to induce vibrational movement of the cutting element relative to the cutting pocket. Moving the drill bit relative to the formation may cause vibration of the rotation-inducing member sufficiently to induce rotation of the cutting element relative to the cutting pocket. In one embodiment, moving the drill bit relative to the formation may cause vibration of the rotation-inducing member such that friction between the cutting element and the cutting pocket is reduced. Further, the rotation-inducing member may comprise a resilient member configured to compress in a direction that is generally transverse to the rotational axis of the cutting element.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
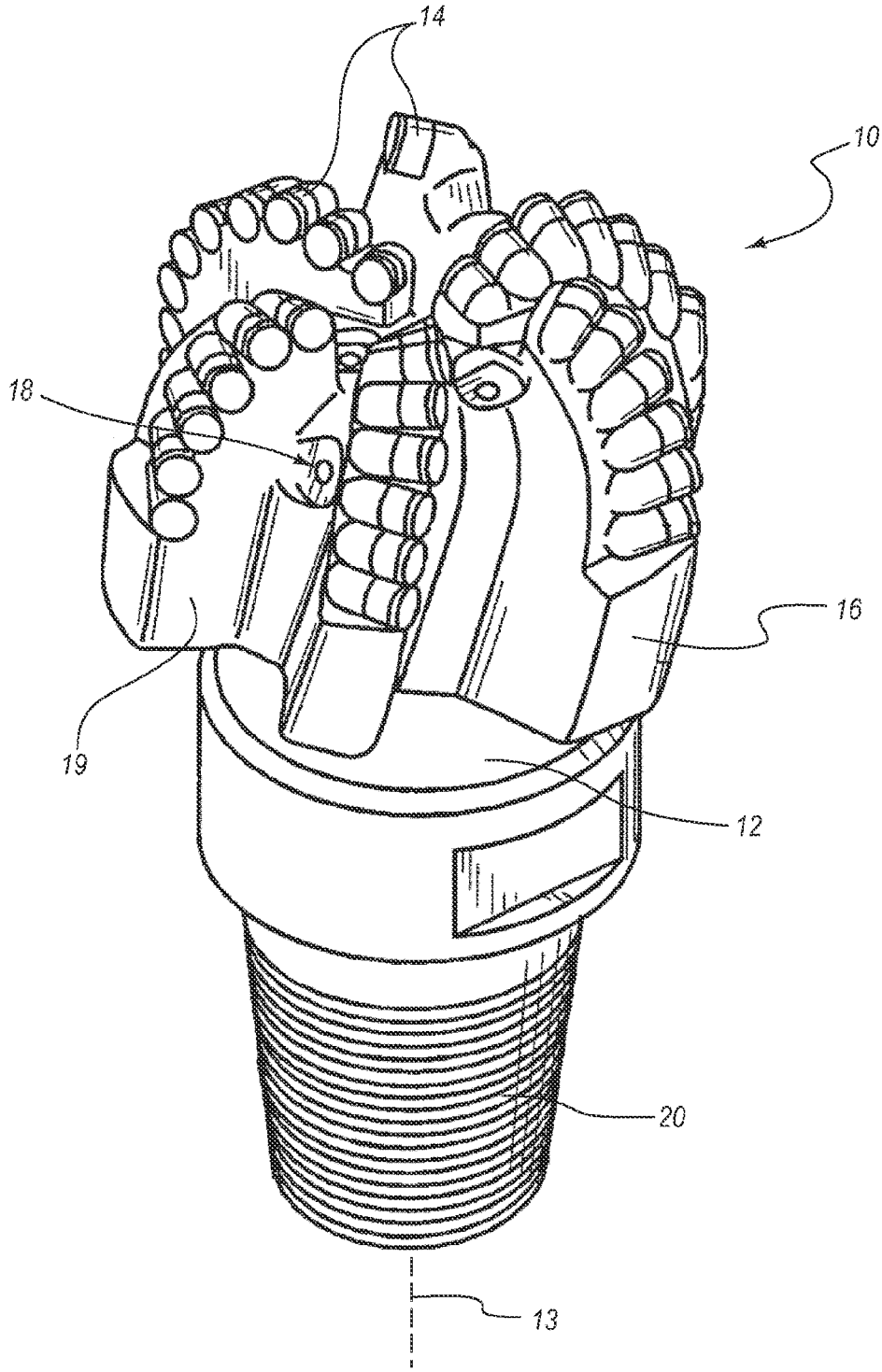
FIG. 1 is a perspective view of a rotary drill bit according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present invention relates generally to drill bits, such as rotary drill bits used for drilling subterranean formations. "Superhard," as used herein, refers to any material having a hardness that is at least equal to a hardness of tungsten carbide. Additionally, a "superabrasive material," as used herein, may refer to a material exhibiting a hardness exceeding a hardness of tungsten carbide, such as, for example, polycrystalline diamond. In addition, as used throughout the specification and claims, the word "cutting" generally refers to any drilling, boring, or the like. The word "cutting," as used herein, refers broadly to machining processes, drilling processes, or any other material removal process utilizing a cutting element.

Figure 2:
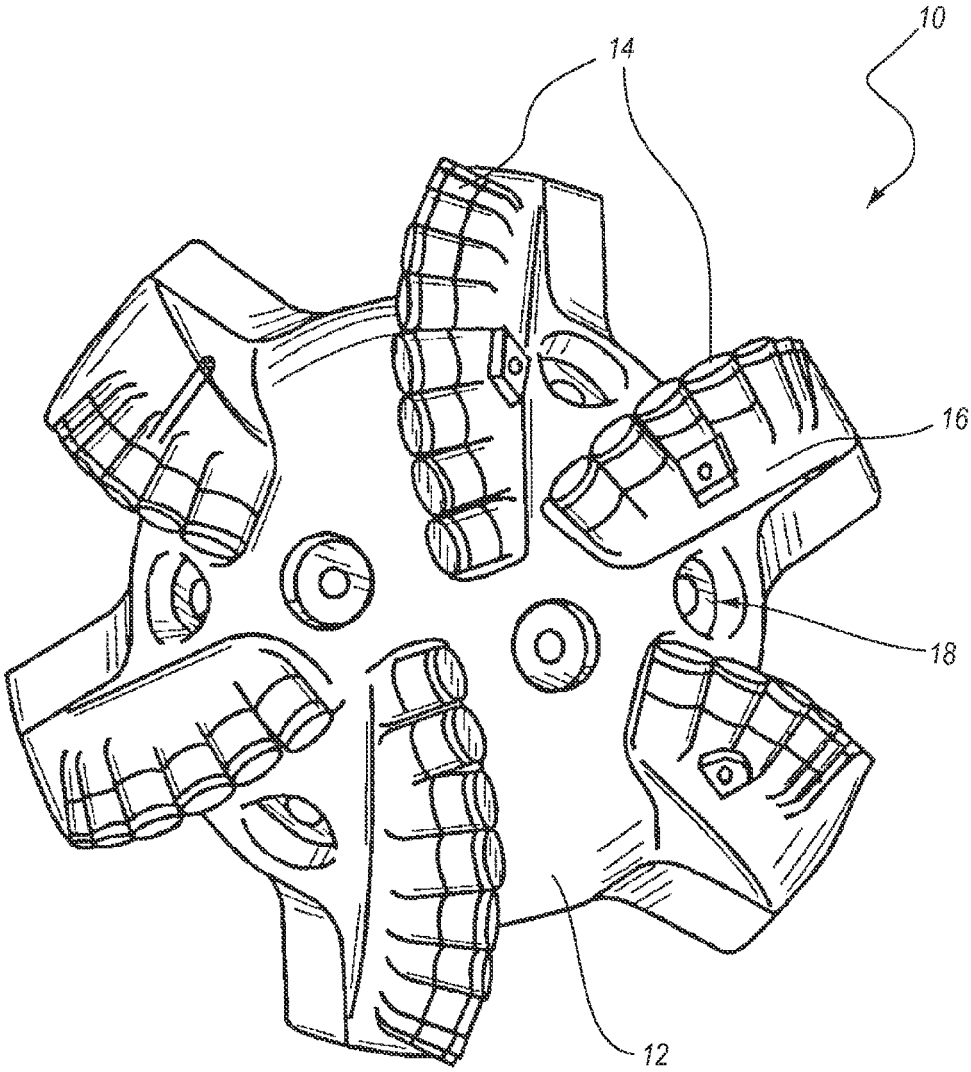
FIG. 2 is a top elevation view of a rotary drill bit according to at least one embodiment.

FIG. 1 is a perspective view of an exemplary rotary drill bit 10 according to at least one embodiment. Rotary drill bit 10 may define a leading end structure for drilling into a formation, such as a subterranean formation or any other material to be drilled. FIG. 2 is a top elevation view of the rotary drill bit 10 illustrated in FIG. 1. As illustrated in these figures, rotary drill bit 10 may comprise a bit body 12 having a rotational axis 13, one or more bit blades 16, and a threaded pin connection 20. More particularly, rotary drill bit 10 may define a leading end structure for drilling into a formation, such as a subterranean formation or any other material to be drilled. Rotary drill bit 10 may also include radially and longitudinally extending bit blades 16, each of which may include a leading face 19. Further, circumferentially adjacent blades 16 may define slots there between that allow material, such as rock debris and drilling fluid, to be conveyed away from the drill bit during a drilling operation. Leading faces 19 on bit blades 16 may face in the direction of rotation of rotary drill bit 10 during a drilling operation. Rotary drill bit 10 may rotate about rotational axis 13. Additionally, a plurality of cutting elements 14 may be secured to bit body 12 of rotary drill bit 10. According to additional embodiments, one or more nozzle cavities 18 may be defined in rotary drill bit 10.

Cutting elements 14 may be mounted to various suitable portions of bit blades 16, as illustrated in FIGS. 1 and 2. According to at least one embodiment, cutting elements 14 may be mounted to portions of bit blades 16 configured to contact a formation during a drilling operation. Cutting elements 14 may have cutting surfaces and cutting edges adjacent to and/or extending from leading faces 19, such that the cutting surfaces and cutting edges contact a formation as rotary drill bit 10 is rotated about rotational axis 13 during a drilling operation. Nozzle cavities 18 defined in rotary drill bit 10 may communicate drilling fluid from the interior of rotary drill bit 10 to cutting elements 14 and various exterior portions of bit body 12. It should be understood that FIGS. 1 and 2 merely depict one example of a rotary drill bit employing various embodiments of a cutting element assembly of the present invention, without limitation. More generally, a rotary drill bit may include at least one cutting element assembly including a cutting element 14 according to the present invention, without limitation.

Figure 3:
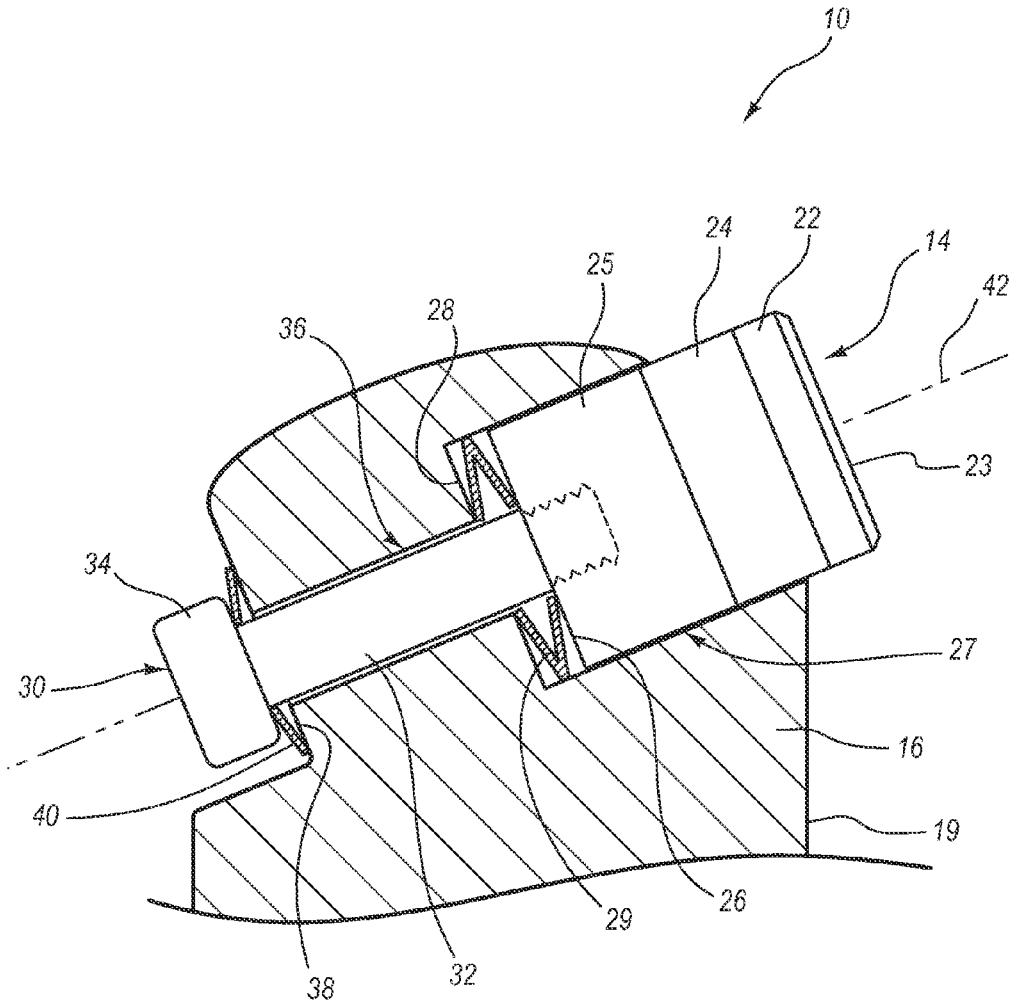
FIG. 3 is a partial cross-sectional side view of a cutting element assembly mounted to a portion of a bit blade according to at least one embodiment.

FIG. 3 is a partial cross-sectional side view of a cutting element assembly, including a cutting element 14 and a structural element 30, mounted to a portion of a bit blade 16 of a rotary drill bit 10 according to at least one embodiment. As illustrated in this figure, cutting element 14 may be positioned at least partially within cutting pocket 27 of bit blade 16. Optionally, at least a portion of cutting face 23 may extend or protrude beyond leading face 19. Additionally, at least a portion of cutting face 23 may be oriented at a selected back rake angle and/or side rake angle. According to additional embodiments, cutting element 14 may be positioned within a cutting pocket 27 on suitable portion of rotary drill bit 10, including portions of rotary drill bit 10 other than bit blade 16. Cutting pocket 27 may be sized to facilitate rotation of cutting element 14. Additionally, cutting pocket 27 may be coated with at least one coating to facilitate rotation of cutting element 14, to reduce friction between cutting element 14 and/or cutting pocket 27, and/or to reduce wear of cutting element 14 and/or cutting pocket 27. The cutting element assembly may embody any of the features disclosed in U.S. patent application Ser. No. 11/148,806, filed on 9 Jun. 2005 and titled "Cutting Element Apparatuses and Drill Bits So Equipped," U.S. patent application Ser. No. 11/899,691, filed on 7 Sep. 2007 and titled "Superabrasive Elements, Methods of Manufacturing, and Drill Bits Including Same," U.S. patent application Ser. No. 12/134,489, filed on 6 Jun. 2008 and titled "Cutting Element Apparatuses and Drill Bits So Equipped," which applications are incorporated herein by reference in their entirety.

Cutting element 14 may include a layer or table 22 affixed to or formed upon a substrate 24. Table 22 may be formed of any material or combination of materials suitable for cutting various types of formations. For example, table 22 may comprise a superhard or superabrasive material such as polycrystalline diamond. In additional embodiments, cutting element 14 may comprise a unitary or integrally formed structure comprising, for example, diamond, silicon carbide, boron nitride, or a combination of the foregoing. Substrate 24 may comprise any material or combination of materials capable of adequately supporting a superabrasive material during drilling of a subterranean formation, including, for example, cemented tungsten carbide. For example, cutting element 14 may comprise a table 22 comprising polycrystalline diamond bonded to a substrate 24 comprising cobalt-cemented tungsten carbide. In at least one embodiment, after formation of table 22, a catalyst material (e.g., cobalt or nickel) may be at least partially removed (e.g., by acid-leaching) from table 22. Table 22 of cutting element 14 may form a cutting face 23, at least a portion of which is generally perpendicular to a central axis 42, and additionally, a circumferential portion of cutting face 23 may be chamfered or may comprise at least one so-called buttress geometry or any other suitable geometry. According to various embodiments, a circumferential portion of cutting face 23 and/or any other suitable portion of table 22 may form a cutting edge. Central axis 42 may be substantially centered (i.e., positioned at a centroid) with respect to a selected cross-sectional area (e.g., a solid cross-sectional area or a cross-sectional area bounded by an exterior surface, without limitation) of cutting element 14.

According to certain embodiments, cutting element 14 may also comprise a base member 25. Base member 25 may be affixed to substrate 24 through any suitable method, such as, for example, brazing. Base member 25 may extend from a back surface of substrate 24 to a back cutting element surface 26 of cutting element 14. According to additional embodiments, back cutting element surface 26 may be defined by substrate 24. Base member 25 and/or substrate 24 may include a recess for facilitating retention of cutting element 14 within cutting pocket 27 of bit blade 16. The recess may be configured for accepting a fastening or support element, wherein the fastening element extends from the recess and may facilitate affixation, support, or securement of the cutting element to a rotary drill bit. The cutting element assembly may embody any of the features disclosed in U.S. patent application Ser. No. 11/148,806, which is incorporated by reference above.

In at least one embodiment, a structural element 30 may be employed in combination with cutting element retention structures or assemblies for securing or supporting cutting element 14 within bit blade 16 of rotary drill bit 10. For example, structural element 30 may include an end portion that is sized and configured to fit within a recess of base member 25 and/or substrate 24. Structural element 30 may also comprise a fastener as known in the art. For example, structural element 30 may comprise a bolt or machine screw (e.g., a socket-head cap screw). Structural element 30 may also comprise any threaded fastener as known in the art, without limitation. Additionally, structural element 30 may comprise a threaded end portion configured to fit within a corresponding threaded recess in base member 25. While structural element 30 is shown attached to base member 25 in FIG. 3, structural element 30 may optionally be attached directly to substrate 24, such as in a case where cutting element 14 that does not include a base member 25. Structural element 30 may be positioned such that central axis 42 extends generally along structural element 30. Accordingly, cutting element 14 and structural element 30 may both be rotatable about central axis 42.

In various embodiments, structural element 30 may comprise a shaft portion 32, which may be positioned within a through hole 36 defined in bit blade 16. Through hole 36 may be sized to allow rotation of shaft portion 32. Additionally, through hole may be coated with at least one coating or may comprise a sleeve, such as a metallic sleeve, to facilitate rotation of shaft portion 32, to reduce friction between shaft portion 32 and/or through hole 36, and/or to reduce wear of shaft portion 32 and/or through hole 36. Structural element 30 may also comprise an anchor portion 34 located at an end portion of structural element 30 opposite cutting element 14. Anchor portion 34 may be adjacent to an anchor surface 38 on bit blade 16. Anchor portion 34 may also be located adjacent an end of through hole 36 opposite cutting pocket 27. In at least one embodiment, anchor portion 34 may be integrally formed with shaft portion 32 of structural element 30. Anchor portion 34 may also be fastened to shaft portion 32. For example, structural element 30 may have a threaded end that engages a threaded aperture in anchor portion 34 comprising a threaded nut. Lock washers or other elements that are used in combination with fasteners (as known in the art) may also be employed in combination with structural element 30.

In at least one embodiment, a biasing element 40 (e.g., a Belleville washer spring or a coil spring) may be positioned between anchor portion 34 and bit blade 16. Biasing element 40 may bias structural element 30 in a selected direction and/or may generate a selected force. For example, biasing element 40 may generally bias cutting element 14 within cutting pocket 27 of bit blade 16. Biasing element 40 may also enable a preload force to be applied to cutting element 14. For example, biasing element 40 may apply a preload force to cutting element 14, which may aid in the rotation of cutting element 14 in response to forces generated during drilling of a formation. Accordingly, biasing element 40 may position cutting element 14 in cutting pocket 27 of bit blade 16 while selectively allowing cutting element 14 to rotate in cutting pocket 27.

In one embodiment, a resilient support member 29 may be positioned between cutting element 14 and cutting pocket 27. Resilient support member 29 may act as a rotation-inducing member, inducing and/or otherwise enabling rotation of cutting element 14 within cutting pocket 27. Resilient support member 29 may be positioned between any suitable portion of cutting element 14 and any suitable portion of cutting pocket 27. For example, as illustrated in FIG. 3, resilient support member 29 may be positioned between back cutting element surface 26 and back cutting pocket surface 28. According to additional embodiments, resilient support member 29 may be positioned radially (relative to central axis 42) between an outer diameter surface portion of cutting element 14 and a portion of cutting pocket 27. Optionally, resilient support member 29 may surround at least a portion of the outer diameter surface portion of cutting element 14 (e.g., at least a portion of base member 25 and/or substrate 24). According to certain embodiments, resilient support member 29 may be disposed in a recess defined in bit blade 16, wherein the recess is open to cutting pocket 27.

According to various embodiments, vibrations may be induced in resilient support member 29 during a drilling operation. For example, cutting element 14 and/or various other portions of rotary drill bit 10 may contact portions of a formation, such as a subterranean rock formation, during a drilling or other cutting operation, causing vibrations to be induced in cutting element 14 and/or other portions of rotary drill bit 10. Any suitable portion of cutting face 23 may contact a formation such that cuttings are removed from the formation. Cuttings may comprise pulverized material, fractured material, sheared material, a continuous chip, or any cuttings produced by abrading a solid material, such as a rock formation, without limitation. Cutting pocket 27 may be sized such that it has a larger diameter than a diameter of cutting element 14 relative to central axis 42. Accordingly, cutting forces during a drilling operation may cause cutting element 14 to move within cutting pocket 27. The vibrations and/or movement induced in cutting element 14 and/or other portions of drill bit 10 may likewise induce vibrations in resilient support member 29. Vibrations induced in resilient support member 29 may reduce or inhibit frictional forces (e.g., static friction) between resilient cutting element 14 and support member 29 and/or between cutting element 14 and various portions of cutting pocket 27, enabling and/or inducing rotation of cutting element 14 within cutting pocket 27 in response to forces acting on cutting element 14 and/or other portions of drill bit 10. Accordingly, cutting forces acting on cutting element 14 during a drilling operation may cause incremental or continuous movement of cutting element 14 within cutting pocket 27 as resilient support member 29 vibrates.

The rotation of cutting element 14 within cutting pocket 27 may significantly decrease wear on cutting element 14, thereby significantly increasing the usable life of cutting element 14 in comparison with conventional cutting elements. As cutting element 14 rotates relative to cutting pocket 27, a surface portion of cutting element 14 exposed to a formation during drilling, such as a portion of cutting face 23, may be periodically changed or substantially continuously changed, in contrast to a conventional cutting element, where the surface portion of a cutting element exposed to a formation remains constant. Rotation of cutting element 14 during a drilling operation may introduce a greater portion of cutting element 14, including cutting face 23, against a formation, which may reduce wear of the cutting element 14. For example, the volume of diamond worn away from cutting element 14 for a given volume of rock cut may be reduced in comparison with a conventional non-rotatable cutting element.

In various embodiments, cutting element 14 may be substantially cylindrical and may rotate about central axis 42. Cutting element 14 may be rotated about central axis 42 in a clockwise direction, in a counter-clockwise direction, or both (i.e., serially). Such rotation may cause a selected portion of table 22, such as cutting face 23 and/or a cutting edge formed by cutting face 23 or any other suitable portion of table 22, to contact material being cut, such as rock material. Cutting element 14 may be rotated in at least one or more directions, intermittently or substantially continuously, so that various portions of table 22, including cutting face 23, interact with a material being cut during a drilling or other cutting operation. At least one lubricant and/or another fluid may be introduced into cutting pocket 27 to facilitate rotation of cutting element 14 within cutting pocket 27 and/or to flush out various debris from cutting pocket 27, such as particles of rock resulting from drilling a rock formation. Fluids introduced into cutting pocket 27 may include, without limitation, drilling mud, air, oil, and/or water.

Various factors may affect the rotation of cutting element 14 in cutting pocket 27, including the extent and/or speed of rotation of cutting element 14 relative to cutting pocket 27. These factors may include, without limitation, the size of cutting element 14, the size of cutting pocket 27, the ratio of a diameter of cutting pocket 27 to a diameter of cutting element 14, and/or vibrational frequencies and magnitudes resulting from cutting forces acting on rotary drill bit 10. Accordingly, the rotation of cutting element 14 may be configured to suit various drilling situations and to maximize the usable life of cutting element 14.

Figure 4:
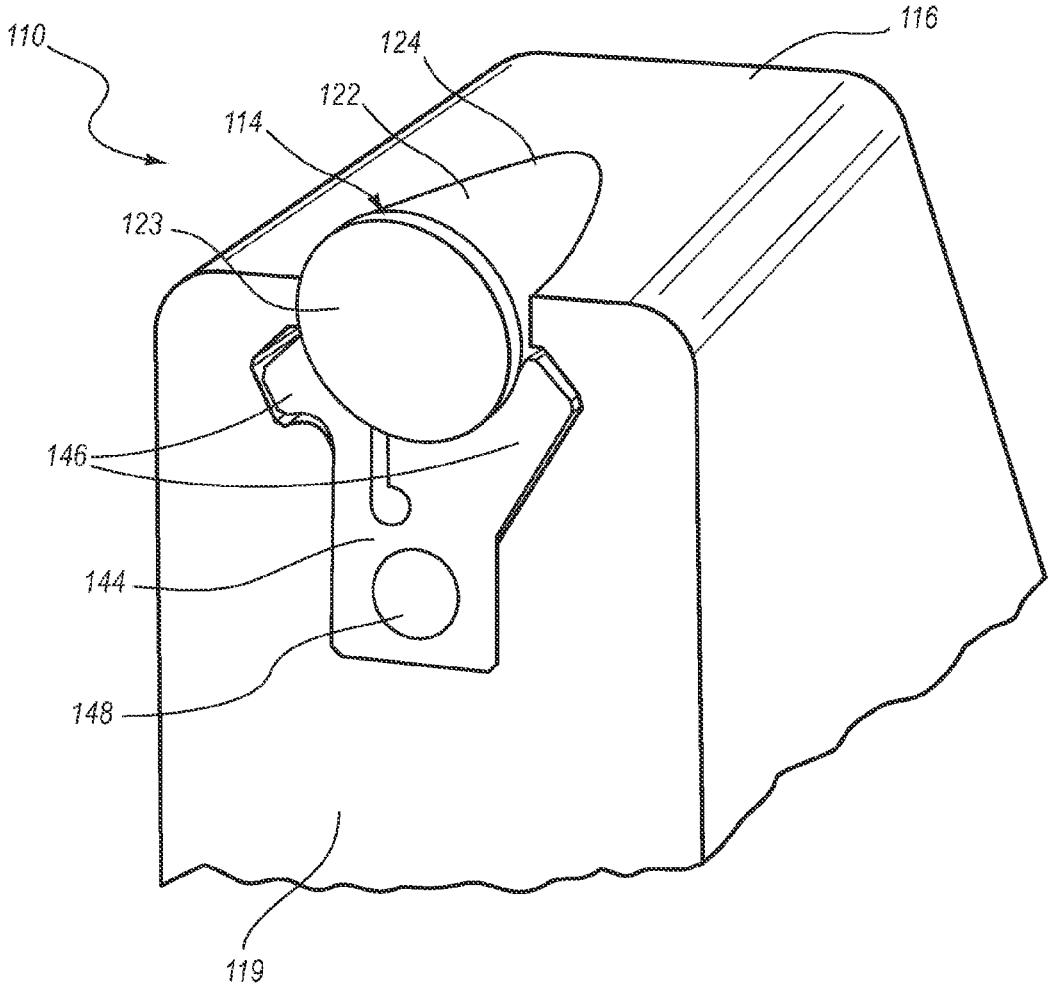
FIG. 4 is a perspective view of a cutting element assembly mounted to a portion of a bit blade according to at least one embodiment.
Figure 5:
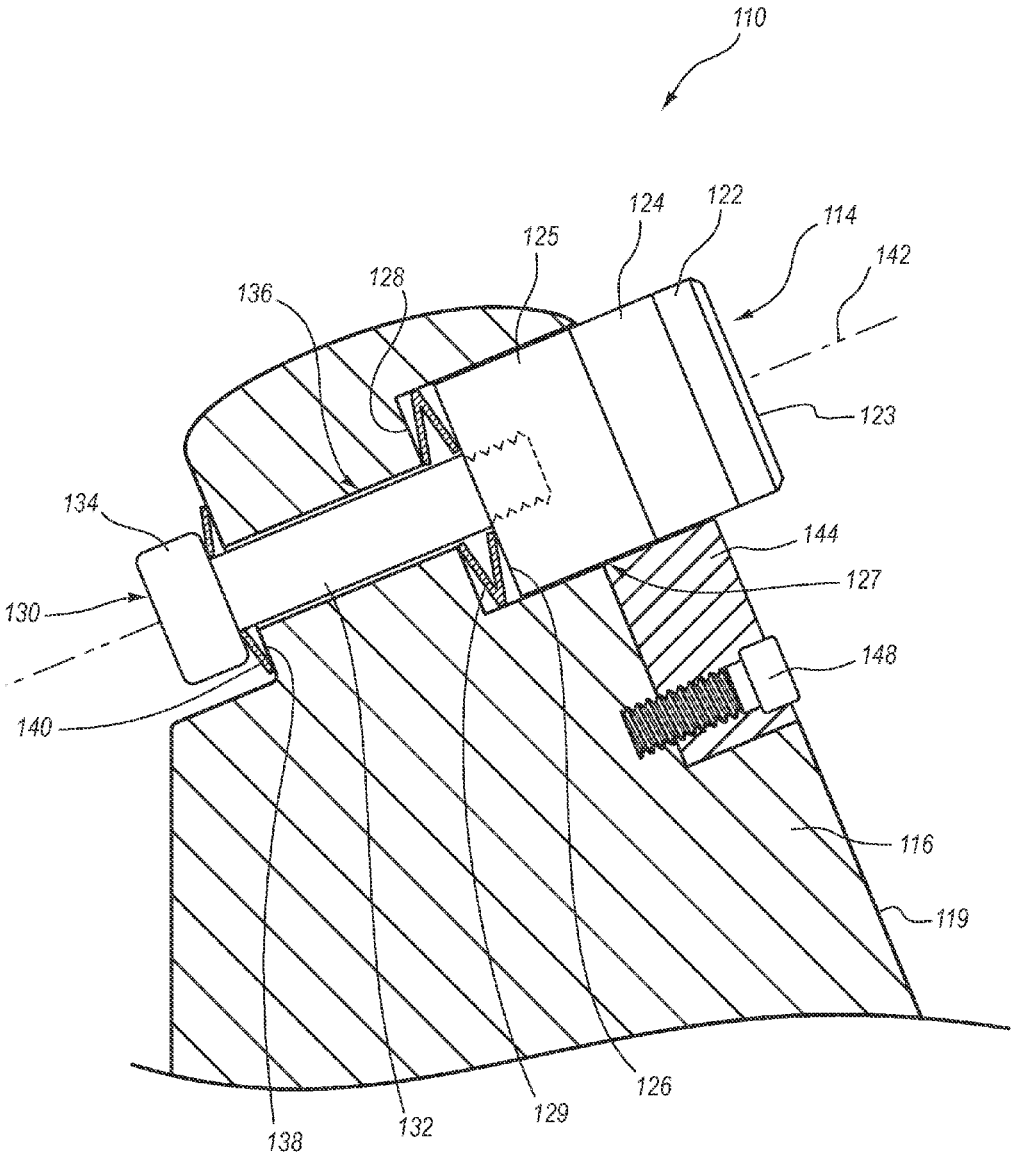
FIG. 5 is a partial cross-sectional side view of a cutting element assembly mounted to a portion of a bit blade according to at least one embodiment.

FIG. 4 is a perspective view of a cutting element assembly, including a cutting element 114, mounted to a portion of a bit blade 116 of a rotary drill bit 110 according to an additional embodiment. FIG. 5 is a partial cross-sectional side view of the cutting element assembly illustrated in FIG. 4, including cutting element 114 and structural element 130, mounted to a portion of bit blade 116 of rotary drill bit 110. As illustrated in these figures, cutting element 114 may be at least partially disposed within cutting pocket 127. Optionally, cutting element 114 may extend from the same side of bit blade 116 as leading face 119. As with previous embodiments, cutting element 114 may include a layer or table 122 affixed to or formed upon a substrate 124. Table 122 of cutting element 114 may form a cutting face 123, at least a portion of which may be generally perpendicular to a central axis 142. Cutting element 114 may also comprise a base member 125 that is affixed to a back surface of substrate 124. Base member 125 may extend from a back surface of substrate 124 to a back cutting element surface 126 of cutting element 114.

In at least one embodiment, a structural element 130 may be employed in combination with cutting element retention structures or assemblies for securing or supporting cutting element 114 within bit blade 116 of rotary drill bit 110. Structural element 130 may comprise a shaft portion 132, which may be positioned within a through hole 136 defined in bit blade 116. Structural element 130 may also comprise an anchor portion 134 located at an end portion of structural element 130 opposite cutting element 114. Anchor portion 134 may be adjacent to an anchor surface 138 on bit blade 116. In at least one embodiment, a biasing element 140 may be positioned between anchor portion 134 and bit blade 116.

According to additional embodiments, a resilient support member 129 may be positioned between cutting element 114 and cutting pocket 127. Resilient support member 129 may be positioned between any suitable portion of cutting element 114 and any suitable portion of cutting pocket 127. For example, resilient support member 129 may be positioned between back cutting element surface 126 and back cutting pocket surface 128. Resilient support member 129 may have a natural frequency encompassing frequencies generated in rotary drill bit 110 during cutting. In at least one embodiment, resilient support member 129 may have a natural frequency of between about 200-1000 hertz. For example, resilient support member 129 may have a natural frequency of about 800 hertz.

In another embodiment, rotary drill bit 110 may additionally comprise a vibrational member 144 positioned adjacent to cutting element 114. Vibrational member 144 may be coupled to bit blade 116 by fastener 148. Fastener 148 may comprise any suitable fastener suitable for coupling vibrational member 144 to bit blade 116, such as, for example, a threaded bolt. As illustrated in FIG. 5, fastener 148 may extend through an aperture in vibrational member 144 and an aperture in bit blade 116, such that vibrational member 144 is attached to bit blade 116. As shown, fastener 148 may be threadedly attached to vibrational member 144 and/or bit blade 116.

Vibrational member 144 may be formed to any suitable shape or size and may be formed of any suitable material, such as, for example, a metallic material. A surface of vibrational member 144 may form at least a portion of a surface of cutting pocket 127 adjacent to cutting element 114. As shown in FIG. 4, vibrational member 144 may at least partially surround cutting element 114. According to various embodiments, vibrational member 144 may comprise a generally "Y" shape, where vibrational member 144 comprises at least two prongs 146 extending at least partially around cutting element 114. Prongs 146 may be induced to vibrate under various circumstances. For example, cutting forces during a drilling operation may cause at least a portion of rotary drill bit 110 to vibrate, which in turn may induce vibration in vibrational member 144. Prongs 146 and/or other portions of vibrational member 144 may be configured to vibrate at a desired frequency and/or magnitude, such as a frequency and/or magnitude suitable for inducing rotation of cutting element 114 within cutting pocket 127. For example, prongs 146 and/or or any other suitable portion of vibrational member 144 may have a natural frequency encompassing frequencies generated in rotary drill bit 110 during cutting. In at least one embodiment, prongs 146 and/or or any other suitable portion of vibrational member 144 may have a natural frequency of between about 200-1000 hertz. For example, prongs 146 and/or or any other suitable portion of vibrational member 144 may have a natural frequency of about 800 hertz.

Prongs 146 may act as support members supporting cutting element 114 within cutting pocket 127. Prongs 146 may also act as resilient members resiliently supporting and/or deflecting cutting element 114 within cutting pocket 127. For example, prongs 146 may vibrate adjacent to cutting element 114, thereby reducing friction between cutting element 114 and cutting pocket 127. Prongs 146 may be either symmetric or asymmetric relative to each other.

According to additional embodiments, vibrational member 144 may vibrate in a manner and at a frequency suitable to induce continuous or incremental rotation of cutting element 114 within cutting pocket 127. For example, vibration of prongs 146 of vibrational member 144 may induce rolling contact rotation of cutting element 114 along a surface portion of cutting pocket 127. Accordingly, vibrations from vibrational member 144 may induce rolling contact rotation between cutting element 114 and cutting pocket 127 such that cutting element 114 moves in a generally circular pattern around at least a portion of cutting pocket 127 (see, e.g., FIGS. 6A-6D). According to certain embodiment, vibrational member 144 may be induced to vibrate through various suitable means other than or in addition to cutting forces, including, for example, through vibrations generated external to and/or within rotary drill bit 210. Vibrations may be generated within or external to rotary drill bit 210 through any suitable means, including, for example, by using piezoelectric actuators to excite vibrational member 144 and/or any other suitable portion of rotary drill bit 10.

FIGS. 6A-6D are front views of a cutting element 214 in various positions in a cutting pocket 227 defined in a bit blade 216. These figures illustrate various positions of cutting element 214 relative to cutting pocket 227 as cutting element 214 rotates within cutting pocket 227. Although a rotation-inducing member is not shown (for clarity) in FIGS. 6A-6D, for example, a vibrational member (see, e.g., vibrational member 144 as shown in FIGS. 4 and 5) or any other suitable rotation-inducing member may induce rotation of cutting element 214 within cutting pocket 227. In at least one embodiment, a rotation-inducing member, such as a vibrational member and/or a resilient support member, may induce and/or otherwise enable rolling contact rotation between cutting element 214 and cutting pocket 227, causing cutting element 214 to rotate in a generally circular pattern around at least a portion of cutting pocket 227. Cutting pocket 227 may be formed to a larger diameter than cutting element 214, and a gap 250 may accordingly be formed between an outer diameter of cutting element 214 and cutting pocket 227. A reference point 252 is shown in FIGS. 6A-6D to illustrate the rotation of cutting element 214 as it rolls around cutting pocket 227.

Figure 6A:
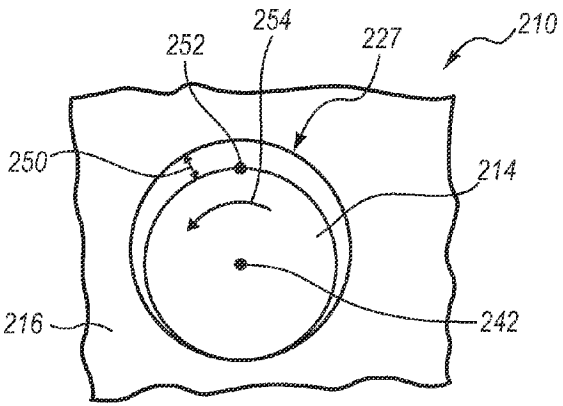
FIG. 6A is a front view of a cutting element in a cutting pocket defined in a bit blade according to at least one embodiment.
Figure 6B:
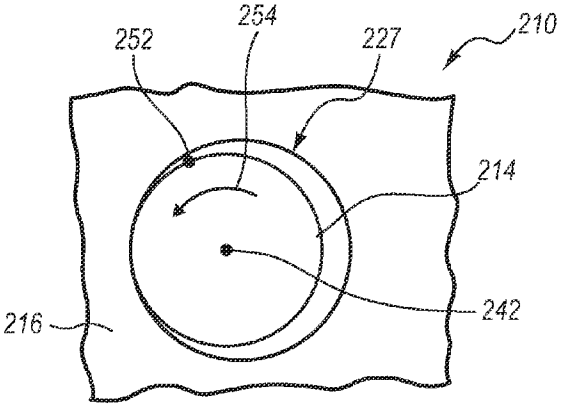
FIG. 6B is a front view of a cutting element in a cutting pocket defined in a bit blade according to at least one embodiment.
Figure 6C:
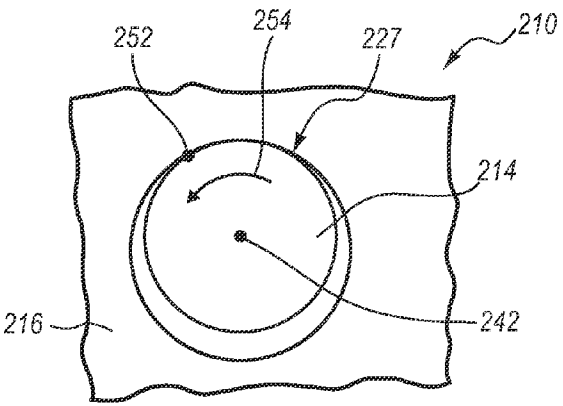
FIG. 6C is a front view of a cutting element in a cutting pocket defined in a bit blade according to at least one embodiment.
Figure 6D:
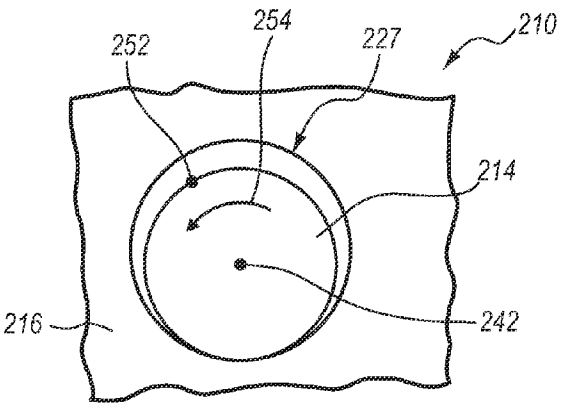
FIG. 6D is a front view of a cutting element in a cutting pocket defined in a bit blade according to at least one embodiment.

As illustrated in FIGS. 6A-6D, as a rotation-inducing member induces rotation of cutting element 214 within cutting pocket 227, cutting element 214 may roll around at least a portion of cutting pocket 227. As illustrated in these figures, as cutting element 214 rotates in direction 254 (counter-clockwise relative to the view in FIGS. 6A-6D), cutting element 214 may move progressively in rolling contact with a surface portion of cutting pocket 227. The progression of cutting element 214 about cutting pocket 227 is illustrated as it rolls in a clockwise direction (opposite of direction 254) about cutting pocket 227. As can be seen in FIGS. 6A-6D, as cutting element 214 rotates about central axis 242 in a counter-clockwise direction 254, central axis 242 (and likewise a center of mass of cutting element 214) may progress around a surface of cutting pocket 227 in a clockwise direction (opposite of direction 254). FIG. 6D shows central axis 242 of cutting element 214 in substantially the same position as central axis 242 of cutting element 214 shown in FIG. 6A. As can be seen in these figures, although central axis 242 of cutting element 214 is in substantially the same position relative to cutting pocket 227 in both FIGS. 6A and 6D, reference point 252 marking a portion of an exterior of cutting pocket 227 is in a different position, indicating net rotation of cutting element 214 relative to cutting pocket 227. In additional embodiments, as cutting element 214 rotates about central axis 242 in a clockwise direction (relative to a front view of cutting element 214), central axis 242 (and likewise a center of mass of cutting element 214) may progress around a surface of cutting pocket 227 in a counter-clockwise direction.

Various factors may affect the rotation of cutting element 214 in cutting pocket 227, including the extent and/or speed of rotation of cutting element 214 relative to cutting pocket 227. These factors may include, without limitation, the size of cutting element 214, the size of cutting pocket 227, the ratio of a diameter of cutting pocket 227 to a diameter of cutting element 214, the size of gap 250 between cutting element 214 and cutting pocket 227, the natural frequency of vibrational member (not shown for clarity purposes), and/or frequencies and magnitudes of vibrations (e.g., circular vibrations) resulting from cutting forces acting on rotary drill bit 210. Details concerning factors that influence rotation of a cutting element, such as circular vibration, may be described in Vibration-Induced Rotation, Patrick Andreas Petri, Massachusetts Institute of Technology, May 2001, which document is incorporated herein by reference in its entirety.

As indicated above, the rotation of cutting element 214 within cutting pocket 227 may significantly increase the usable life of cutting element 214 in comparison with conventional cutting elements. For example, rotation of cutting element 214 may intermittently or substantially continuously renew a portion of cutting element 214 exposed to a material being cut, thereby reducing an amount and/or depth of wear of cutting element 214 during a cutting period. In another example, rotating the cutting element 214 tends to spread the heat input over a larger volume of the cutting element 214. Spreading the heat input to the cutting element 214 may lead to longer life. Accordingly, the rotation of cutting element 214 may be configured and adjusted to suit various drilling situations and to maximize the usable life of cutting element 214.

Figure 7A:
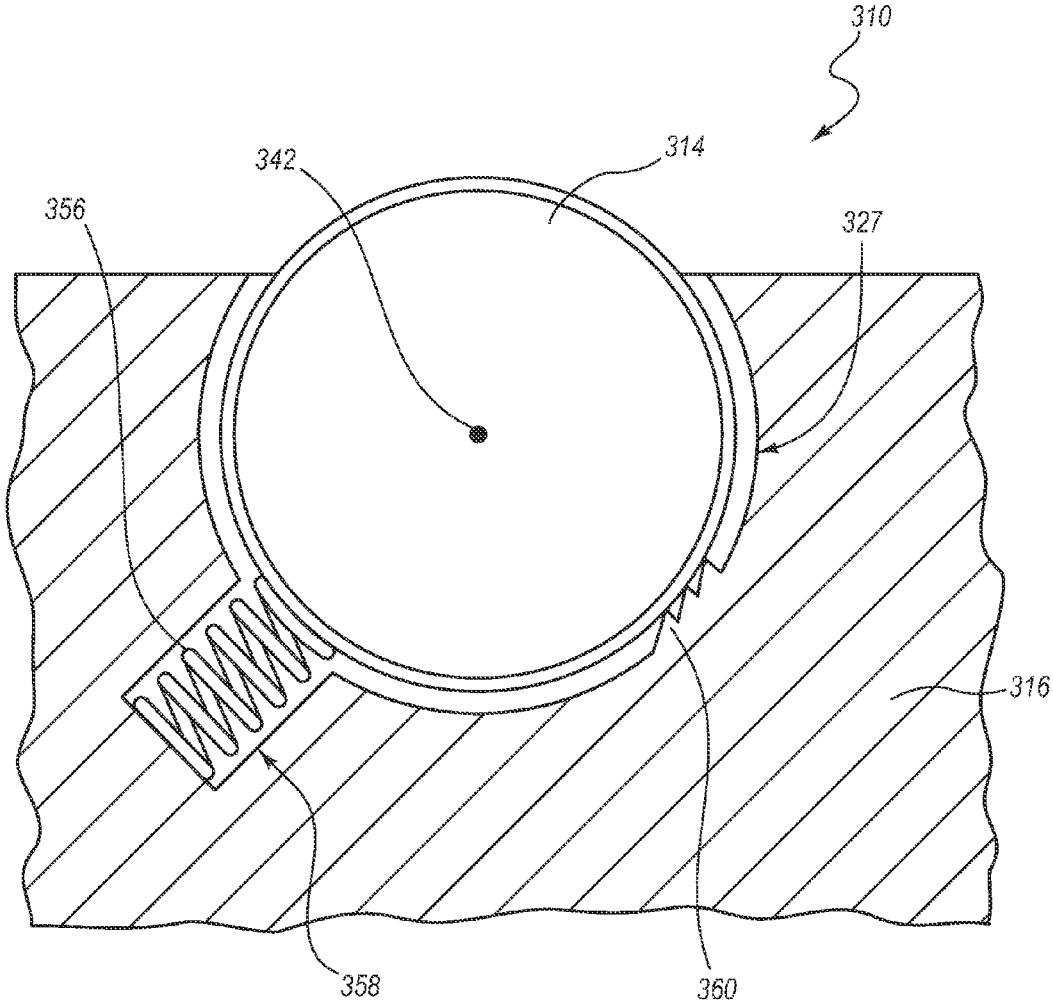
FIG. 7A is a partial cross-sectional front view of a cutting element in a cutting pocket defined in a bit blade according to at least one embodiment.
Figure 7B:
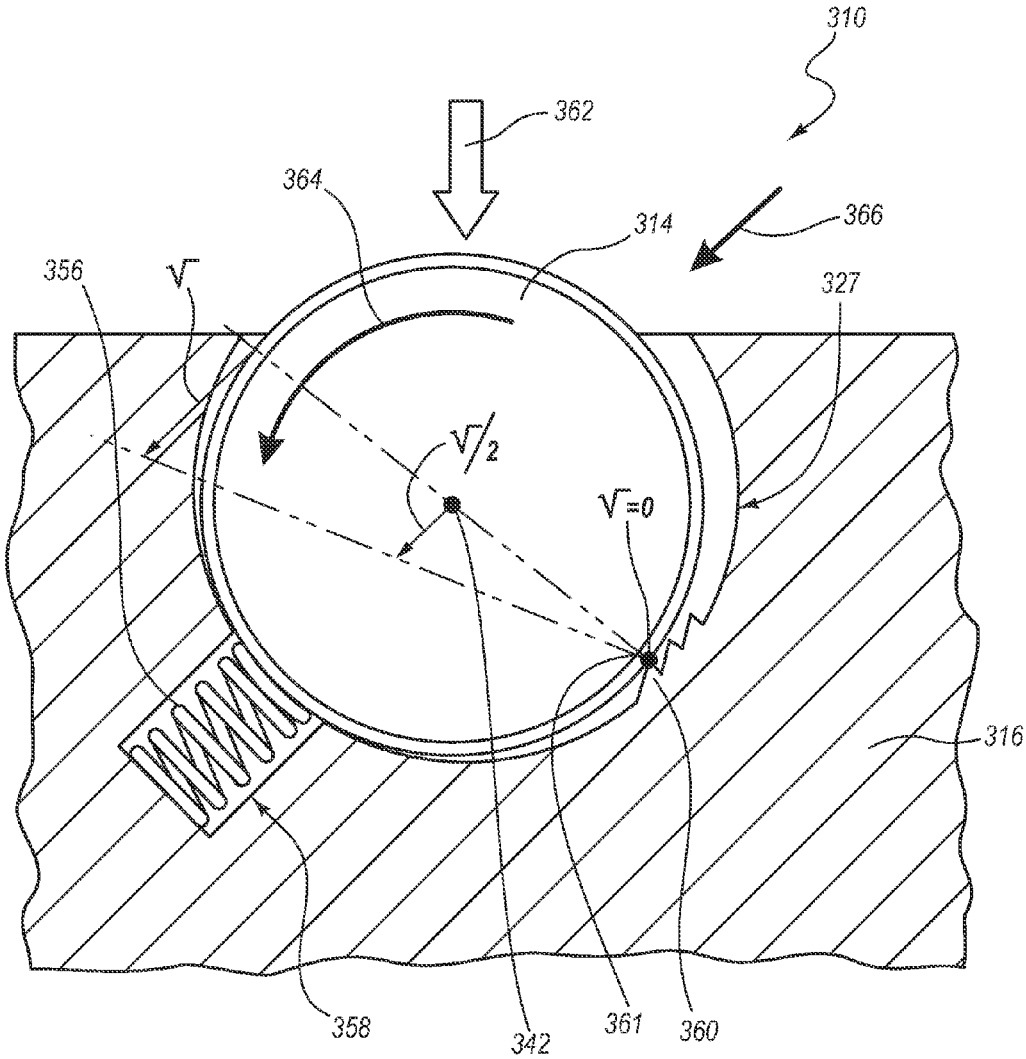
FIG. 7B is a partial cross-sectional front view of a cutting element in a cutting pocket defined in a bit blade according to at least one embodiment.
Figure 7C:
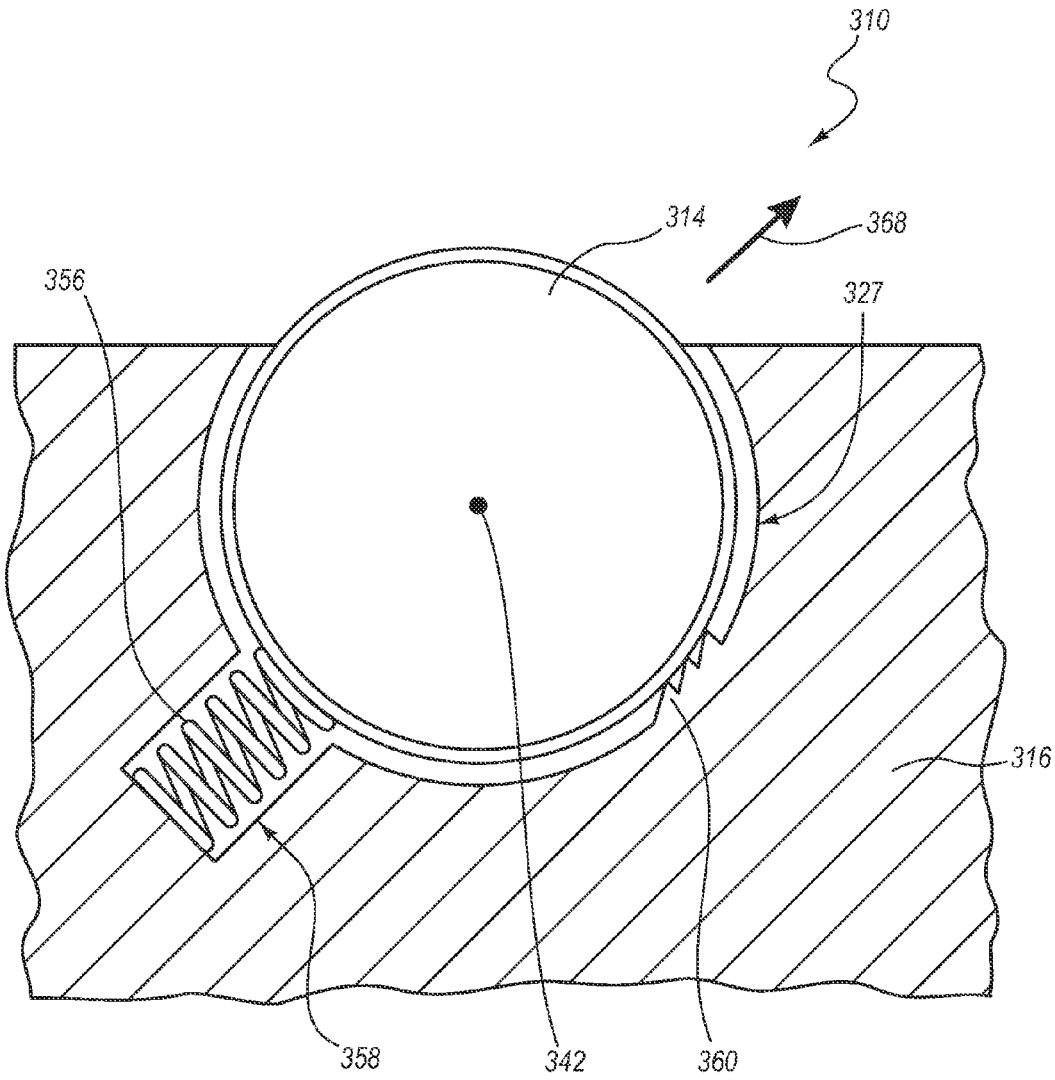
FIG. 7C is a partial cross-sectional front view of a cutting element in a cutting pocket defined in a bit blade according to at least one embodiment.

FIGS. 7A-7C are partial cross-sectional front views of a cutting element 314 in a cutting pocket 327 defined in a bit blade 316 according to at least one embodiment. As illustrated in this figure, cutting element 314 may be at least partially disposed within cutting pocket 327. As with previous embodiments, cutting element 314 may include a layer or table 322 affixed to or formed upon a substrate 324. Table 322 of cutting element 314 may form a cutting face 323, at least a portion of which is generally perpendicular to a central axis 342.

In another embodiment, a vibrational member 356 may be positioned adjacent to cutting element 314. For example, as illustrated in FIGS. 7A-7C, vibrational member 356 may be positioned within a recess 358 adjacent to cutting pocket 327, such that vibrational member 356 protrudes from recess 358 into cutting pocket 327. Vibrational member 356 may comprise any configuration and material that is capable of compressing and/or deflecting under a force, and that is capable of later returning to non-compressed and/or or deflected state upon removal of the force. For example, vibrational member 356 may comprise a spring member that is capable of compressing under a cutting force. According to various embodiments, bit blade 316 may also comprise one or more protrusions 360 adjacent to cutting element 314. As shown in FIGS. 7A-7C, protrusions 360 may also extend from a portion of bit blade 316 adjacent cutting pocket 327 into cutting pocket 327. Protrusions 360 may be formed to any shape suitable to facilitate rotation of cutting element 314.

According to at least one embodiment, vibrational member 356 and protrusions 360 may facilitate rotation of cutting element 314 within cutting pocket 327 as cutting element 314 is exposed to external forces, such as cutting forces experienced during a drilling operation. For example, as shown in FIG. 7A, cutting element 314 may be separated from a surface of cutting pocket 327 under various conditions, forming a gap between at least a portion of cutting element 314 and cutting pocket 327 (see, e.g., gap 250 in FIG. 6A). Cutting element 314 may be maintained in the position shown in 7A through various support means, including, for example, by vibrational member 356 abutting an exterior of cutting element 314. In additional embodiments, a structural element, a biasing element, an additional vibrational member, and/or any other suitable support components may maintain cutting element 314 separated from a surface of cutting pocket 327 under various conditions (see, e.g., FIGS. 3-5).

As shown in FIG. 7B, a force may be applied to cutting element 314 generally in direction 362. As the force is applied to cutting element 314 in direction 362, cutting element 314 may be forced generally in direction 362 until cutting element 314 contacts protrusions 360. Upon contacting protrusions 360, cutting element 314 may be inhibited from moving further in direction 362, and cutting element 314 may then move generally in direction 366 toward vibrational member 356. Protrusions 360 may comprise substantially pointed and/or or textured protrusions extending into cutting pocket 327. Protrusions 360 may also comprise any frictional material capable of frictionally contacting and/or engaging cutting element 314 as cutting element moves in at least one direction. As cutting element 314 moves in direction 366, cutting element 314 may compress vibrational member 356.

Additionally, as cutting element 314 moves in direction 366, an exterior portion of cutting element 314 may contact and/or engage protrusions 360, causing cutting element 314 to rotate (e.g., tip, tilt, and/or slide) in direction 364 (counterclockwise relative to the view in FIG. 7B). In other words, an exterior portion of cutting element 314 may engage protrusions 360 such that the exterior portion of cutting element 314 engaging protrusions 360 is inhibited from sliding past protrusions 360 in direction 366. Accordingly, as cutting element 314 is moved generally in direction 366, the exterior portion of cutting element 314 engaging protrusions 360 may remain positioned at protrusions 360 as central axis 342 moves in direction 366, causing cutting element 314 to rotate about an instant center 361 in direction 364. The instant center 361 has an instantaneous no slip condition where a velocity ("v") of the cutting element 314 is zero (see FIG. 7B). The point or axis of rotation of the cutting element 314 depends at least in part on whether the cutting element is slipping relative to the protrusions 360.

Protrusions 360 may be formed such that protrusions 360 allow for rotation of cutting element 314 generally in direction 364, and such that protrusions 360 interfere with rotation of cutting element 314 generally in a direction opposite to direction 364. As cutting element 314 rotates in direction 364, cutting element 314 may tend to roll or slide over protrusions 360. Cutting element 314 may continue to move generally in direction 366 until a force in direction 362 is decreased, until cutting element 314 comes in contact with a portion of cutting pocket 327 adjacent to vibrational member 356, and/or until cutting element 314 compresses and/or deflects vibrational member 356 to a maximum degree.

As shown in FIG. 7C, a force exerted against cutting element 314 in direction 362 (see FIG. 7B) may be reduced or removed such that vibrational member 356 pushes cutting element 314 away from a portion of a side of cutting pocket 327 adjacent to vibrational member 356. As illustrated in FIG. 7C, vibrational member 356 may displace cutting element 314 generally in direction 368. As cutting element 314 moves in direction 368, cutting element 314 may slide past protrusions 360 such that cutting element 314 does not substantially rotate within cutting pocket 327. As discussed above, protrusions 360 may be formed such that they promote rotation of cutting element 14 in one direction. Accordingly, as illustrated in FIGS. 7A-7C, cutting element 314 may experience a net rotation within cutting pocket 327 in direction 364 (see FIG. 7B) about central axis 342. Additional application of force to cutting element 314 generally in direction 362 (see FIG. 7B), and subsequent reduction or removal of that force, may result in further net rotation of cutting element in direction 364.

According to certain embodiments, protrusions 360 may optionally be formed such that they promote rotation as cutting element moves generally in direction 366, and additionally, protrusions 360 may be formed such that they restrict or inhibit rotation as cutting element 14 moves generally in direction 368. In such an embodiment, cutting element 314 may experience a net rotation about central axis 342 in a direction opposite direction 364.

Figure 8A:
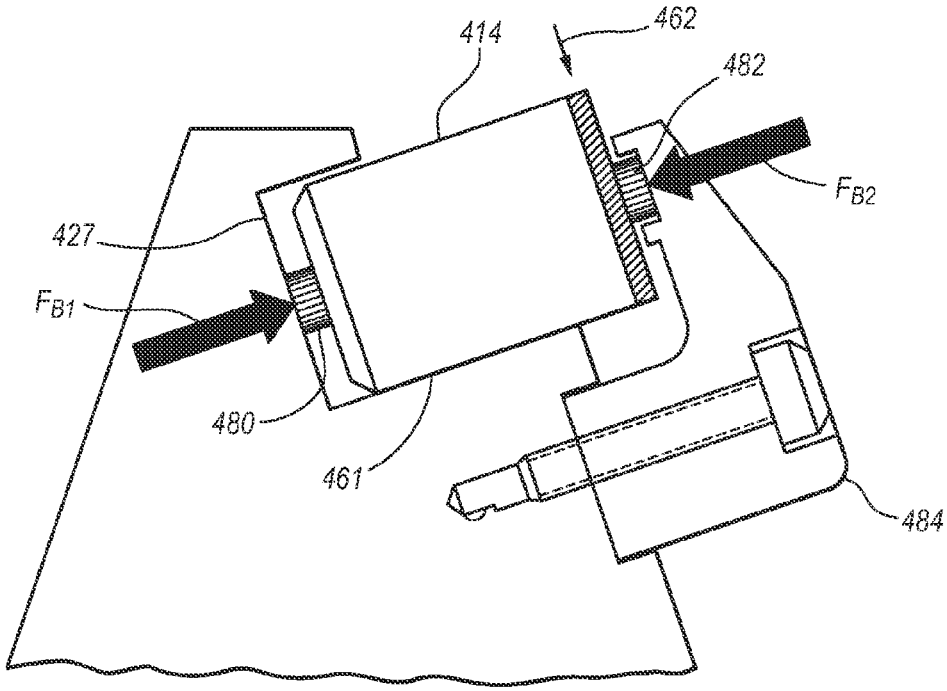
FIG. 8A is a partial cross-sectional side view of a cutting element assembly mounted to a portion of a bit blade according to at least one embodiment.
Figure 8B:
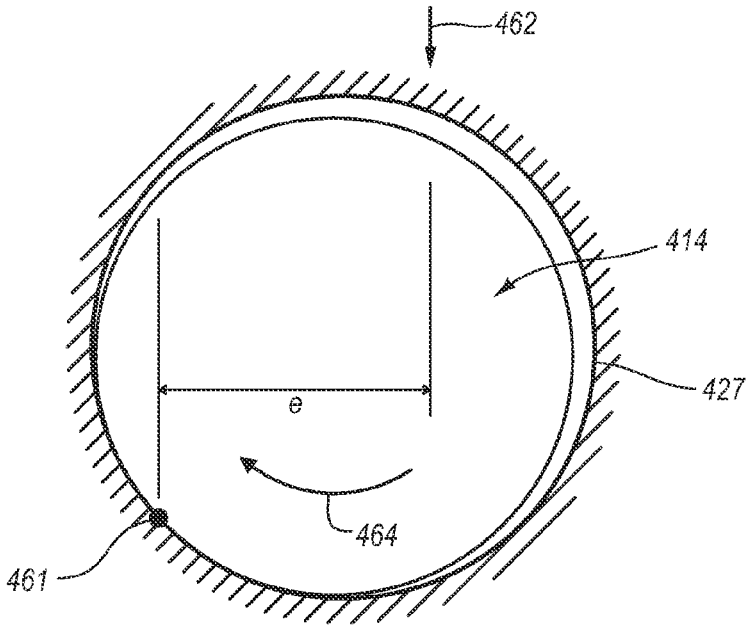
FIG. 8B is a partial cross-sectional front view of a cutting element in a cutting pocket defined in a bit blade according to at least one embodiment.

Another embodiment shown in FIGS. 8A-8B includes a cutting element 414 that is supported on opposing ends by a first and second bearings 480, 482. The first bearing 480 is supported in a cutting pocket 427. The second bearing 482 is supported by a bearing support bracket 484. Opposing forces FB1 and FB2 are applied along a longitudinal axis of the cutting element 414 at the bearings 480, 482. Various bearing structures can be used for bearing 480, 480 and can include, for example, a point contact bearing surface with the cutting element 414.

Rotation of the cutting element 414 is determined by a line contact 461 between the cutting pocking 427 and cutting element 414. Relatively little force can change a position of the line contact 461. Typically, cutting forces will no act through the line contact 461, which can result in an eccentricity "e" that represents a moment arm for a cutting force applied in direction 462. The cutting force applied in direction 462 acting at a distance "e" from the line contact 461 produces a torque that rotates the cutting element 414 in direction 464. Vibration from the cutting forces tends to reset the cutting element 414 within the cutting pocket 427 and make another incremental rotation possible.

The size and position of the first and second bearings 480, 482 helps minimize a torque that resists rotation of the cutting element 414. An axial preload from the forces FB1 and FB2 helps keep the cutting element 414 from binding in the cutting pocket 427 and helps maintain a quasi stable position of the cutting element 414 in the cutting pocket 427.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A rotary drill bit, comprising:

a bit body;

a cutting pocket defined in the bit body;

at least one protrusion in the cutting pocket;

a recess comprising a blind hole positioned adjacent the cutting pocket;

a vibrational member disposed within the recess and extending into the cutting pocket;

a cutting element rotatably coupled to the bit body, the cutting element being positioned at least partially within the cutting pocket and in contact with the vibrational member.

2. The rotary drill bit of claim 1, wherein a gap is defined between the cutting element and the cutting pocket.

3. The rotary drill bit of claim 2, wherein the cutting element is coupled to the bit body such that the cutting element may be moved within the cutting pocket to engage and disengage the at least one protrusion.

4. The rotary drill bit of claim 3, wherein the vibrational member maintains contact with the cutting element as the cutting element moves within the cutting pocket.

5. The rotary drill bit of claim 4, wherein the vibrational member deflects upon movement of the cutting element within the cutting pocket.

6. The rotary drill bit of claim 5, wherein the vibrational member includes a spring member.

7. The rotary drill bit of claim 2, wherein the cutting element is substantially cylindrical and the gap is located between a circumferential surface of the substantially cylindrical cutting element and an adjacent surface of the cutting pocket.

8. The rotary drill bit of claim 7, wherein vibrational member engages the circumferential surface of the substantially cylindrical cutting element.

9. The rotary drill bit of claim 7, wherein the at least one protrusion is located adjacent to, and configured to engage, the circumferential surface of the substantially cylindrical cutting element.

10. The rotary drill bit of claim 1, wherein the at least one protrusion is configured to engage with a surface of the cutting element to effect rotation of the cutting element in a first direction and inhibit rotation of the cutting element in a second, opposite direction.

11. The rotary drill bit of claim 10, wherein the at least one protrusion includes a plurality of protrusions.

12. The rotary drill bit of claim 11, wherein the cutting element, the cutting pocket and the plurality of protrusions are configured such that at least one of the protrusions of the plurality of protrusions maintains contact with the cutting element as the cutting element is displaced within the pocket.

13. The rotary drill bit of claim 1, wherein the vibrational member is configured to alternately compress and decompress in response to variations in cutting forces.

14. The rotary drill bit of claim 1, wherein the cutting element comprises a substrate and a superabrasive material bonded to the substrate.

15. The rotary drill bit of claim 14, wherein the superabrasive material comprises polycrystalline diamond and wherein the substrate comprises cemented tungsten carbide.

16. A method of drilling a subterranean formation, the method comprising:

engaging the subterranean formation with a drill bit having a bit body, a cutting pocket defined in the bit body and a cutting element rotatably coupled to the bit body and being positioned at least partially within the cutting pocket;

contacting a circumferential surface of the cutting element with a vibrational member;

contacting the circumferential surface of the cutting element with at least one protrusion extending from a surface of the cutting pocket;

displacing the cutting element within the cutting pocket from a first position to a second position and applying a force to the vibrational member in response to a force applied to the cutting element during engagement of the subterranean formation by the drill bit.

17. The method according to claim 16, further comprising engaging the cutting element with the at least one protrusion and rotating the cutting element as the cutting element is displaced from the first position to the second position.

18. The method according to claim 17, further comprising applying force to the cutting element by the vibrational element and returning the cutting element from the second position to the first position.

19. The method according to claim 18, further comprising sliding the cutting element past the at least one protrusion as the cutting element returns from second position to the first position.

20. The method according to claim 16, wherein the at least one protrusion includes a plurality of protrusions, and wherein the cutting element disengages at least one of the plurality of protrusions as the cutting element rotates and is displaced from the first position to the second position.

21. A rotary drill bit, comprising:

a bit body;

a cutting pocket defined in the bit body;

at least one protrusion in the cutting pocket;

a recess positioned adjacent the cutting pocket;

a vibrational member disposed within the recess and extending into the cutting pocket;

a cutting element rotatably coupled to the bit body, the cutting element being positioned at least partially within the cutting pocket and in contact with the vibrational member, wherein the vibrational member is configured to alternately compress and decompress in response to variations in cutting forces.

22. The rotary drill bit of claim 21, wherein the cutting element comprises a substrate and a superabrasive material bonded to the substrate.

23. The rotary drill bit of claim 22, wherein the superabrasive material comprises polycrystalline diamond and wherein the substrate comprises cemented tungsten carbide.

24. A rotary drill bit, comprising:

a bit body;

a cutting pocket defined in the bit body;

at least one protrusion in the cutting pocket;

a recess positioned adjacent the cutting pocket;

a vibrational member disposed within the recess and extending into the cutting pocket;

a cutting element rotatably coupled to the bit body such that the cutting element may be moved within the cutting pocket to engage and disengage the at least one protrusion, the cutting element being positioned at least partially within the cutting pocket and in contact with the vibrational member;

wherein a gap is defined between the cutting element and the cutting pocket;

wherein the vibrational member maintains contact with the cutting element as the cutting element moves within the cutting pocket; and wherein the vibrational member deflects upon movement of the cutting element within the cutting pocket.

25. The rotary drill bit of claim 24, wherein the vibrational member includes a spring member.

26. The rotary drill bit of claim 24, wherein the cutting element comprises a substrate and a superabrasive material bonded to the substrate.

27. The rotary drill bit of claim 26, wherein the superabrasive material comprises polycrystalline diamond and wherein the substrate comprises cemented tungsten carbide.

* * * * *